US008807404B1

(12) United States Patent
Howell et al.

(10) Patent No.: US 8,807,404 B1
(45) Date of Patent: Aug. 19, 2014

(54) HOLSTER RETENTION DEVICE

(71) Applicant: Here Be Dragons, LLC, Oxford, ME (US)

(72) Inventors: Frank A. Howell, Oxford, ME (US); Justin A. Kiger, Standish, ME (US)

(73) Assignee: Here Be Dragons, LLC, Oxford, ME (US)

( * ) Notice: Subject to any disclaimer, the term of this patent is extended or adjusted under 35 U.S.C. 154(b) by 17 days.

(21) Appl. No.: 13/737,046

(22) Filed: Jan. 9, 2013

(51) Int. Cl.
*F41C 33/02* (2006.01)

(52) U.S. Cl.
CPC ..... *F41C 33/0263* (2013.01); *F41C 33/02* (2013.01); *F41C 33/0227* (2013.01)
USPC ..... 224/243; 224/242; 224/247; 224/250

(58) Field of Classification Search
CPC ... F41C 33/02; F41C 33/0227; F41C 33/0263
USPC ..... 224/243, 242, 247, 250
See application file for complete search history.

(56) References Cited

U.S. PATENT DOCUMENTS

| | | | | |
|---|---|---|---|---|
| 3,804,306 | A * | 4/1974 | Azurin | 224/193 |
| 4,450,992 | A * | 5/1984 | Casull | 224/163 |
| 5,127,566 | A | 7/1992 | Beletsky | |
| 5,282,559 | A * | 2/1994 | Wisser et al. | 224/243 |
| 5,501,380 | A * | 3/1996 | Wu | 224/243 |
| 5,501,381 | A | 3/1996 | Rogers et al. | |
| 5,944,239 | A * | 8/1999 | Rogers et al. | 224/193 |
| 6,371,341 | B1 | 4/2002 | Clifton, Jr. | |
| 6,467,660 | B1 | 10/2002 | Rogers et al. | |
| 6,604,657 | B2 * | 8/2003 | Yirmiyahu et al. | 224/243 |
| 6,769,581 | B2 | 8/2004 | Rogers et al. | |
| 7,448,116 | B1 * | 11/2008 | Howell | 24/614 |
| 7,461,765 | B2 * | 12/2008 | French et al. | 224/243 |
| 8,011,544 | B1 * | 9/2011 | Howell | 224/668 |
| 8,602,275 | B1 * | 12/2013 | Kiger et al. | 224/243 |
| 2009/0321480 | A1 * | 12/2009 | Kincaid et al. | 224/243 |

* cited by examiner

*Primary Examiner* — Brian D Nash
(74) *Attorney, Agent, or Firm* — Gesmer Updegrove LLP

(57) ABSTRACT

A quick release device for preventing unintended withdrawal of a handgun from a holster comprises a generally U-shaped hood with mutually spaced legs spanned by a bridge. The legs are arranged to straddle the holster, with the hood being rotatable about a fixed first axis between a rearward position at which the bridge overlies the holster opening, and a forward position at which the bridge is removed from the holster opening. At least one interior side plate is fixed with respect to the holster at a location adjacent to one of the hood legs. The interior side plate defines a guide path bordered by and extending forwardly from a locking notch. A trigger plate is connected to the hood leg for rotation about a second axis parallel to the first axis. The trigger plate is rotatable about the second axis to disengage the boss from the locking notch, thereby freeing the boss for movement along the guide path as the hood is rotated about the first axis from its rearward position to its forward position.

18 Claims, 9 Drawing Sheets

HOLSTER RETENTION DEVICE

BACKGROUND

1. Field

This invention relates generally to handgun holsters, and is concerned in particular with strap or hood locking mechanisms designed to secure the handguns in the holsters while providing quick access to the handguns.

2. Description of Related Art

Locking devices employing hoods or straps ("hood/strap") are known, as disclosed for example in U.S. Pat. No. 5,501,381 (Rogers et al.). Here, the hood/strap must first be pushed downward to unlock the device, and then pushed forward to rotate it away from its securing position over the holstered handgun. Such devices have numerous drawbacks, not the least of which is the danger that the device can be unlocked inadvertently by a downward and forward impact against the prominently positioned hood/strap, or worse by an assailant grabbing the handgun with a "raking" motion.

In an attempt at minimizing such drawbacks, and as disclosed in U.S. Pat. No. 6,371,341 (Clifton), releasable blocking mechanisms have been added to either prevent rotation of the hood/strap after it has been pushed downwardly, or to prevent the hood or strap from being initially pushed downwardly.

When intentionally drawing a handgun restrained by such prior art devices, the user's hand must land on the top of the hood/strap, push it down and forward, and then reach back to grip the handgun and draw it out of the holster. This two step procedure is suboptimal when the user is confronted with an urgent situation. Another, perhaps faster, procedure is to grip the butt of the handgun and place the thumb on a land fashioned into the side of the hood/strap. To draw the handgun, the thumb first pushes the land down to draw the hood/strap downward into the unlocked position, and then the thumb drives the hood/strap forward, rotating it free of the handgun. This draw method is also suboptimal because the palm of the hand is pulled awkwardly away from the butt of the handgun as the thumb is used to drive the hood/strap forward into the disengaged position. Although the hand remains, generally, in closer proximity to the butt of the weapon, the user must still shift the palm of the hand back down to re-grip the handgun, compromising the stability of user's hand at this critical moment. Additionally, the user's thumb must slide uncomfortably across the surface of the hood/strap's thumb land as they rotate in relationship to each other as the hood/strap pivots.

Another drawback with such prior art devices stems from the positioning of the pivot point of the hood/strap directly beneath the hood/strap. This is problematic because this relationship immediately starts to draw the leading edge of the hood/strap downward as it begins its pivot forward from its location in vertical alignment with the pivot point. If the handgun is not fully inserted into the holster in such a manner that it is in contact with the hood/strap, the handgun must first be pushed farther down into the holster to create enough clearance for the hood/strap to start its rotation.

Known hood/strap locking mechanisms also are prone to being fouled by clothing. Heavy shirts, coats, and the like can restrict access to the release buttons while bunching up between the holster and the wearer's body. For soldiers, mounting these hood/strap based holsters on body armor is particularly problematic. The hard, unyielding surface of armor plating can interfere with the rotating hood or the operation of release buttons when the holster is securely mounted against it. A suboptimal prior art solution for these tendencies is to install a large auxiliary shield between the holster retention mechanisms and the wearer; these contrivances are expensive and prone to snagging in unwanted ways.

SUMMARY

Broadly stated, embodiments of the present invention address the above described problems of known hood/strap locking mechanisms by obviating any need to push the hood/strap downwardly prior to rotating it forwardly to gain access to the handgun, and by employing an improved and conveniently accessible locking and safety mechanisms for preventing unwanted forward rotation of the hood/strap.

In exemplary embodiments of the present invention, a generally U-shaped hood has mutually spaced legs spanned by a bridge. The legs are arranged to straddle the holster, with the hood being translatably fixed with respect to and rotatable about a fixed first axis between a rearward position at which the bridge overlies the holster opening to prevent withdrawal of a hand gun from the holster, and a forward position at which the bridge is removed from the holster opening to permit such withdrawal. At least one interior side plate is fixed with respect to the holster at a location adjacent to one of the hood legs. The interior side plate is contoured to define a guide path bordered by and extending forwardly from a locking notch. A trigger plate is connected to the hood leg for rotation about a second axis parallel to the first axis. The trigger plate has a boss projecting into the guide path. A spring exerts a yieldable force on the trigger plate urging its boss into the locking notch when the hood is in its rearward position, with the interengagement of the boss with the locking notch serving to lock the hood in its rearward position. The trigger plate is rotatable about the second axis to overcome the force of the spring and to disengage the boss from the locking notch, thereby freeing the boss for movement along the guide path as the hood is rotated about the first axis from its rearward position to its forward position.

Preferably, both interior and exterior side plates are provided. The side plates have complimentary profiles and are arranged in a confronting interconnected relationship to define a space therebetween, with the hood leg, trigger plate and spring being located in that space.

Advantageously, the guide path and locking notch are defined by a shallow groove in the interior surface of the inner side plate.

Preferably, the aforesaid boss is located on one side of the trigger plate, and the second axis is defined by a second boss on the opposite side of the trigger plate which projects into a hole in the hood leg.

A generally U-shaped saddle is positioned over a front end of the holster, with arms straddling and fixed with respect to the sides of the holster, and with the legs of the hood being connected to the saddle arms for rotation about the first axis. Preferably, the distal ends of the saddle arms are received in pockets in the sides of the holster.

The locking notch is preferably located rearwardly with respect to a central plane containing the first axis and the hood when in its rearward position.

A safety lever may advantageously be provided for releasably preventing rotation of the trigger plate to disengage its boss from the locking notch.

The safety lever is mounted between the inner and outer side plates, and is pivotally adjustable about a third axis parallel to the first and second axes between a first position abutting and preventing rotation of the trigger plate, and a second position permitting such rotation.

A safety setting mechanism may be provided for setting the safety lever in its first position. The safety setting mechanism may comprise a pin accessible from the front of the quick release device and arranged for slidable movement into and out of engagement with the safety lever.

These and other features and attendant advantages will now be described in greater detail with reference to the accompanying drawings, wherein:

DETAILED DESCRIPTION

Figure 1:
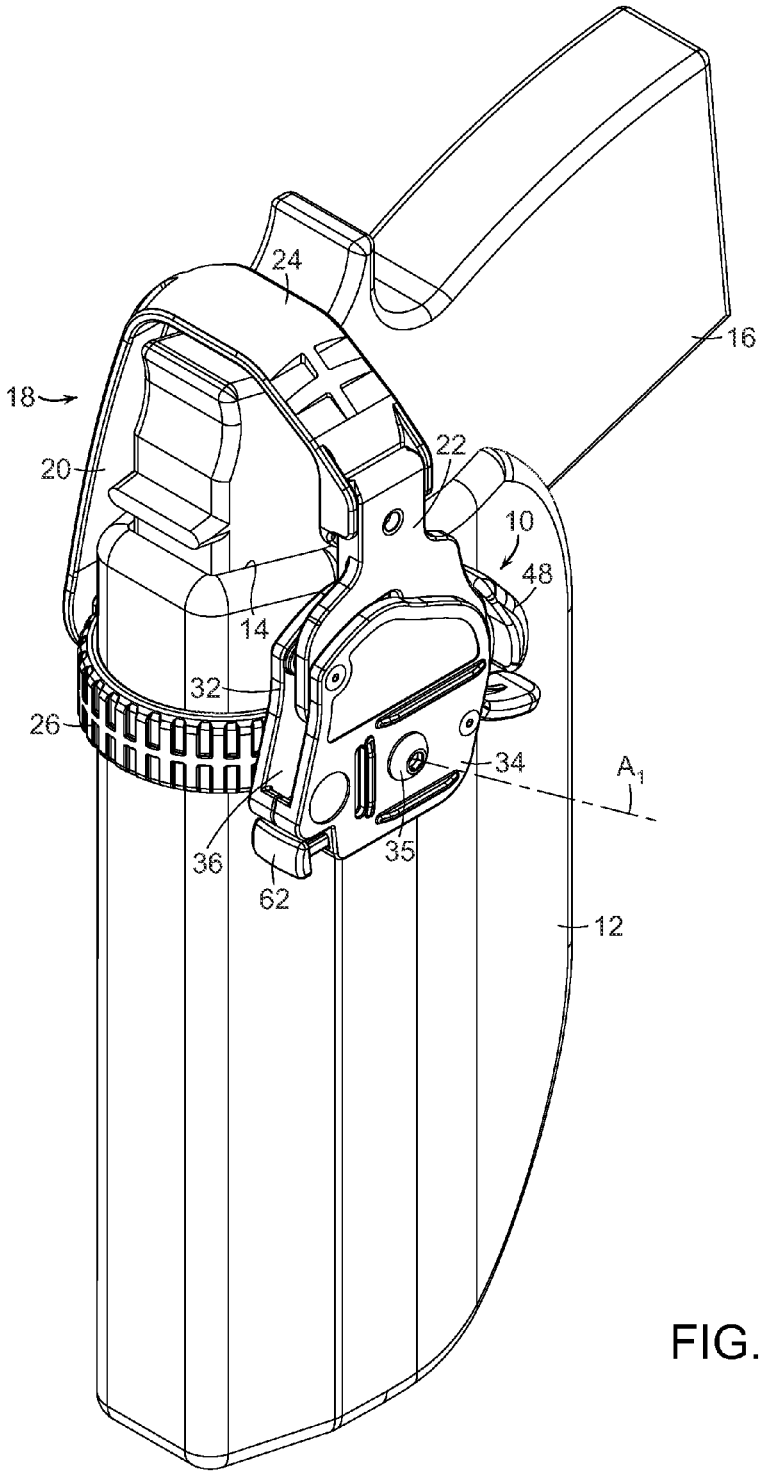
FIG. 1 is a front perspective view of a quick release device in accordance with an exemplary embodiment of the present invention, shown in a locked position retaining a sidearm in a holster.
Figure 2:
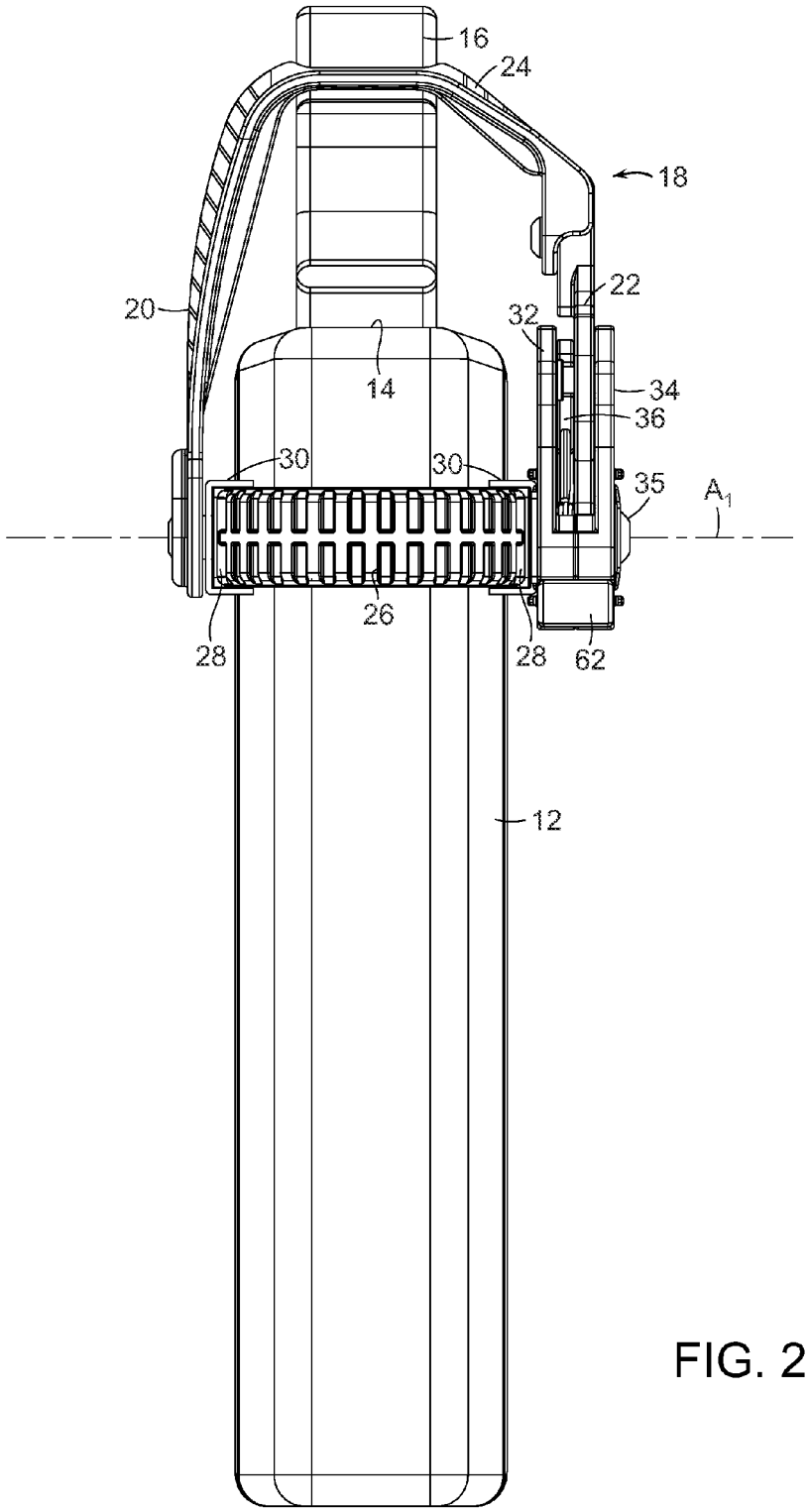
FIG. 2 is a front view of the quick release device shown in FIG. 1.
Figure 3:
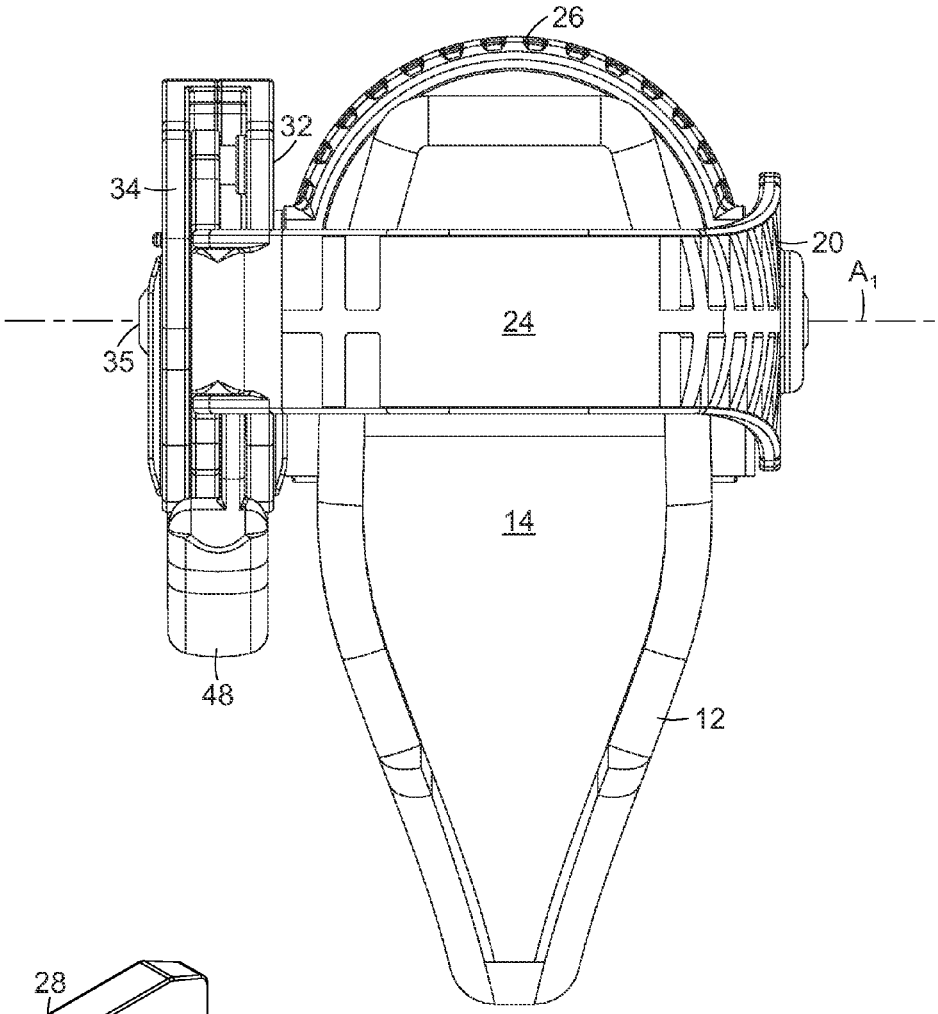
FIG. 3 is a top plan view of the quick release device, shown in FIGS. 1 and 2, with the handgun removed from the holster.

With reference initially to FIGS. 1-3, a quick release device in accordance with an exemplary embodiment of the present invention is generally depicted at 10. The quick release device is mounted on a holster 12 having an upper opening 14 through which a handgun 16 may be inserted and removed.

The quick release device 10 comprises a generally U-shaped hood 18 having mutually spaced inner and outer legs 20, 22 spanned by a bridge 24. The hood legs 20, 22 are arranged to straddle the holster 12.

Figure 3A:
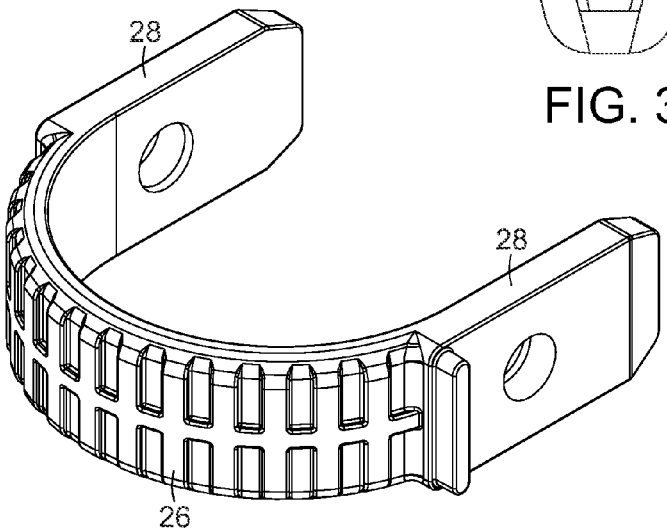
FIG. 3A is a perspective view of the saddle.

A generally U-shaped saddle 26 is positioned over the front of the holster 12. As can best be seen in FIG. 3A, the saddle 26 has rearwardly projecting arms 28 straddling and fixed with respect to the sides of the holster. Preferably, the ends of the arms 28 are received in pockets 30 in the holster sides. The legs 20, 21 of the hood 18 are connected to the saddle arms 28 for rotation about a first axis "$A_1$".

Preferably, the saddle 26 is resilient, such that in the case of fabric holsters, the saddle arms 28 may serve to urge the holster sides apart in an open position, and also serve to exert inward retaining forces on a handgun inserted in the holster.

An inner side plate 32 is fixed with respect to the holster 12. A complimentarily profiled outer side plate 34 is arranged in a confronting interconnected relationship with the inner side plate 32 to define a space 36 therebetween. The outer hood leg 22 and a trigger plate 38 are sandwiched between the inner and outer side plates 32, 34. The inner and outer side plates 32, 24 are interconnected by a fastener 35 defining the first axis $A_1$.

Figure 5:
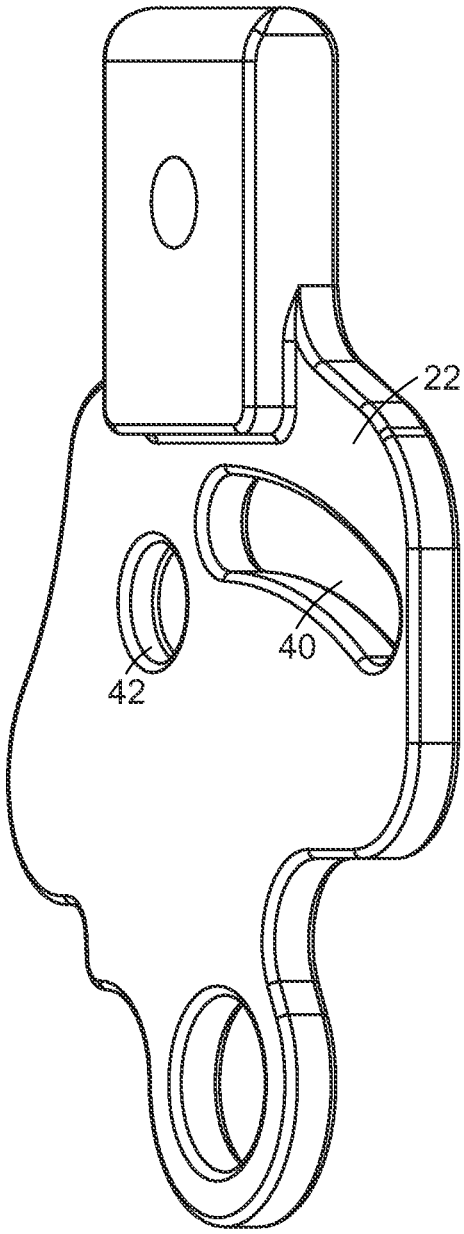
FIG. 5 is a perspective view showing the inner surface of the outer leg of the hood.

As can be best seen in FIG. 5, the outer hood leg 22 has an arcuate slot 40 and a blind hole 42 in its interior side.

Figure 6:
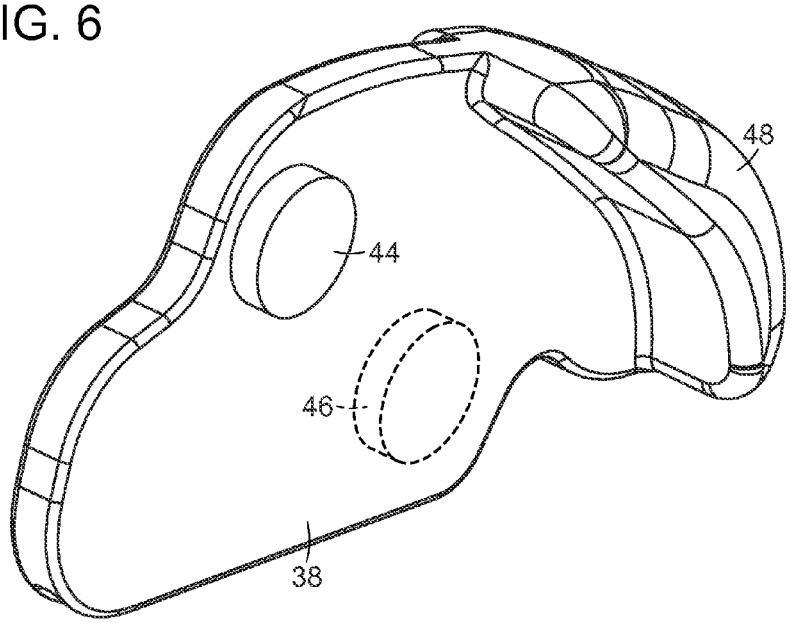
FIGS. 6 and 7 are front and back perspective views of the trigger plate.
Figure 7:
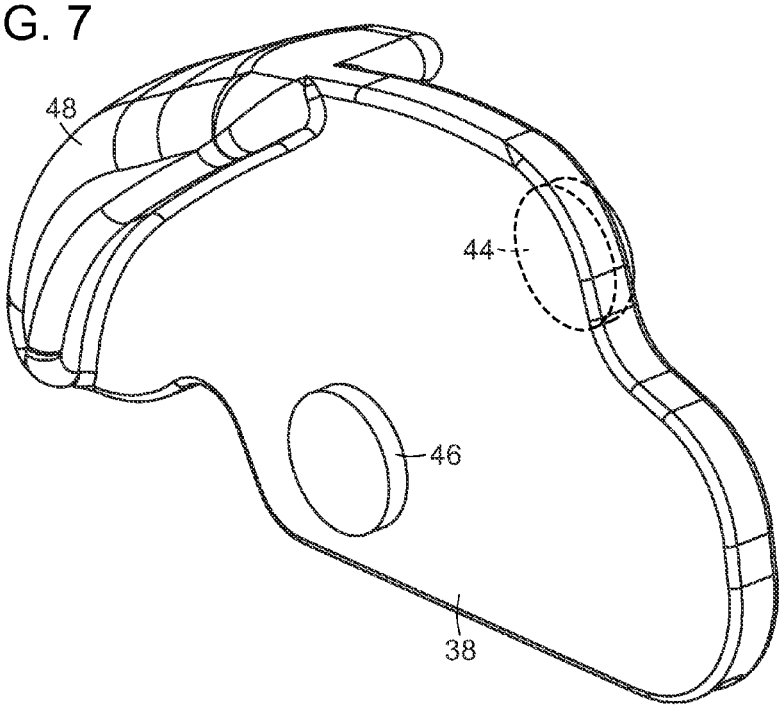

With reference to FIGS. 6 and 7, it will be seen that the trigger plate 38 has a front boss 44 projecting laterally from its front side, a rear boss 46 projecting laterally in the opposite direction from its back surface, and a downwardly curved spoon shaped thumb landing surface 48.

Figure 8:
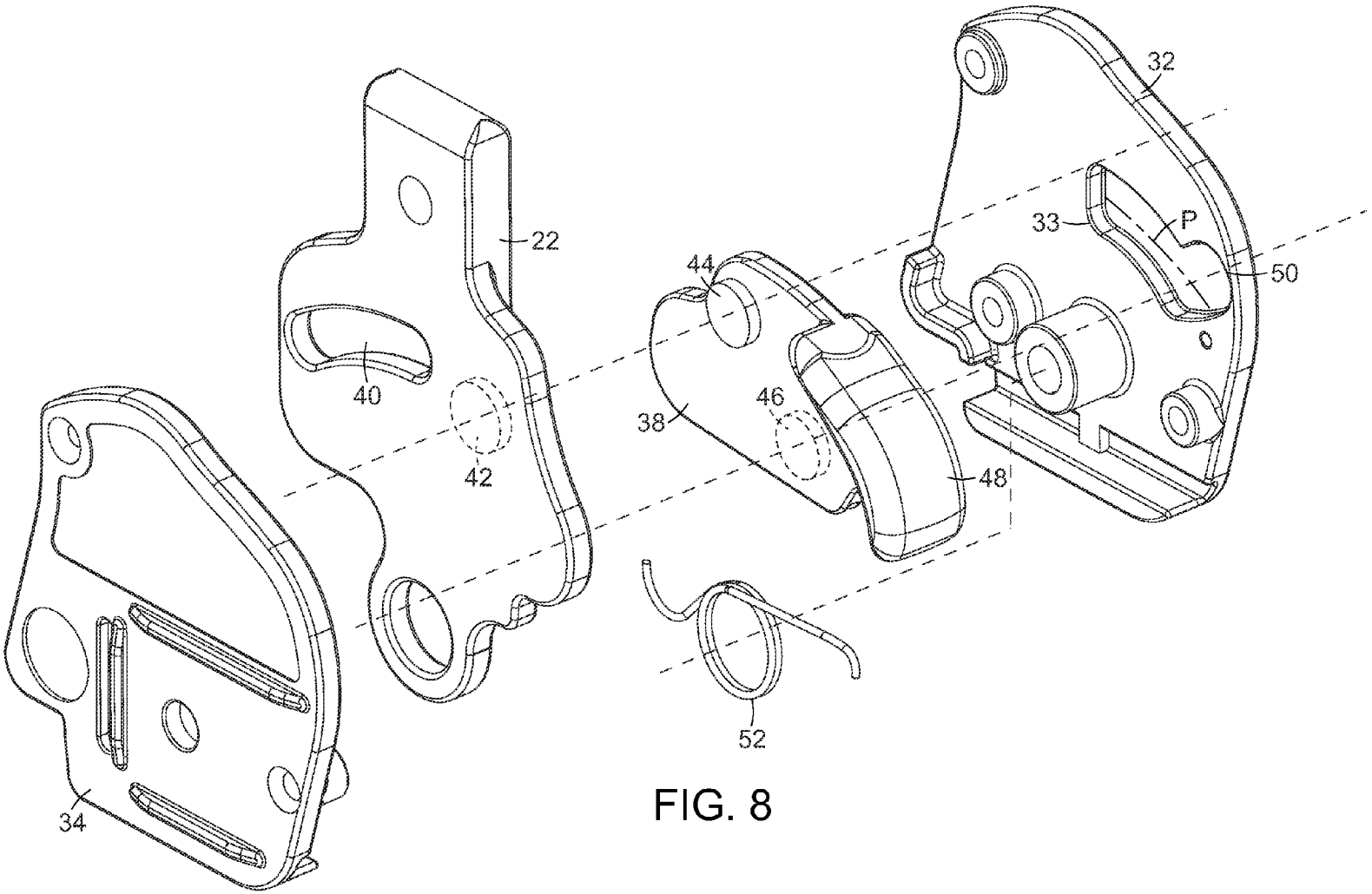
FIG. 8 is an exploded perspective view showing the relationship between the inner side plate, trigger plate, spring and the outer hood leg.

As can be best seen in FIG. 8, the interior side of the inner side plate 32 has a shallow groove 33 contoured to define a path "P" bordered by and extending forwardly from a locking notch 50.

In the assembled device, the front boss 44 of the trigger plate 38 is received in the blind hole 42 of the outer hood leg 22 to define a second axis "$A_2$" parallel to the first axis $A_1$ and about which the trigger plate 38 is rotatable between locked and unlocked positions. The rear boss 46 of the trigger plate 38 projects into the groove 33 in the interior side of the inner side plate 32.

Figure 4:
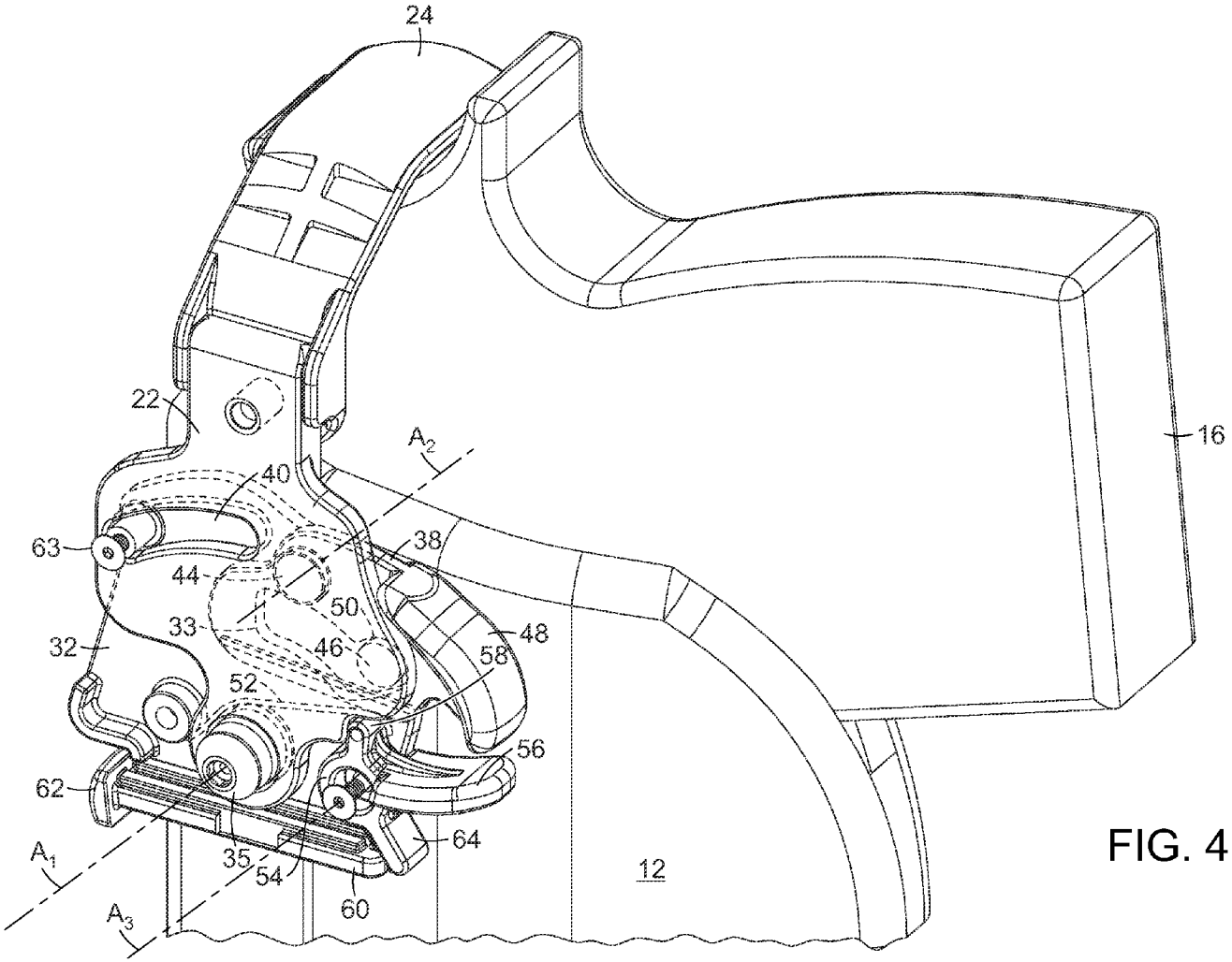
FIG. 4 is a rear perspective view of the quick release device in a locked condition, with the outer side plate removed to better illustrate internal components.

The quick release device 10 is depicted in FIG. 4 in its closed and locked position. A torsion spring 52 has its mid-section encircling the fastener 35, with one end anchored with respect to the side plates 32, 34, and with its other end bearing against the underside of the trigger plate 38. The torsion spring 52 exerts a yieldable force rotatably urging the trigger plate about the second axis $A_2$ to seat the rear boss 46 of the trigger plate in the locking notch 50.

A safety lever 54 is mounted between the inner and outer side plates 32, 34 for pivotal movement about a third axis "$A_3$" parallel to the first and second axes $A_1$, $A_2$. The safety lever has a second thumb landing surface 56 underlying the thumb landing surface 48 of the trigger plate 38, and a shoulder 58 configured and arranged to engage and prevent rotation of the trigger plate 38 about axis $A_2$. A safety setting device comprises a pin 60 with an enlarged head 62 accessible from the front of the quick release device. The pin may be pushed rearwardly to engage an arm 64 on the safety lever 54 to rotatably set the safety lever in its operative position preventing rotation of the trigger plate.

It will thus be seen that in the condition shown in FIG. 4, the outer hood leg 22 and hence the entire hood 18 is locked in its closed position by virtue of the engagement of the trigger plate's rear boss 46 in the locking notch 50. One of the fasteners 63 interconnecting the inner and outer side plates 32, 34 projects across the forward end of the slot 40 in the outer hood leg 22. The trigger plate is held in its locked position by the shoulder 58 of the safety lever 54.

Figure 9:
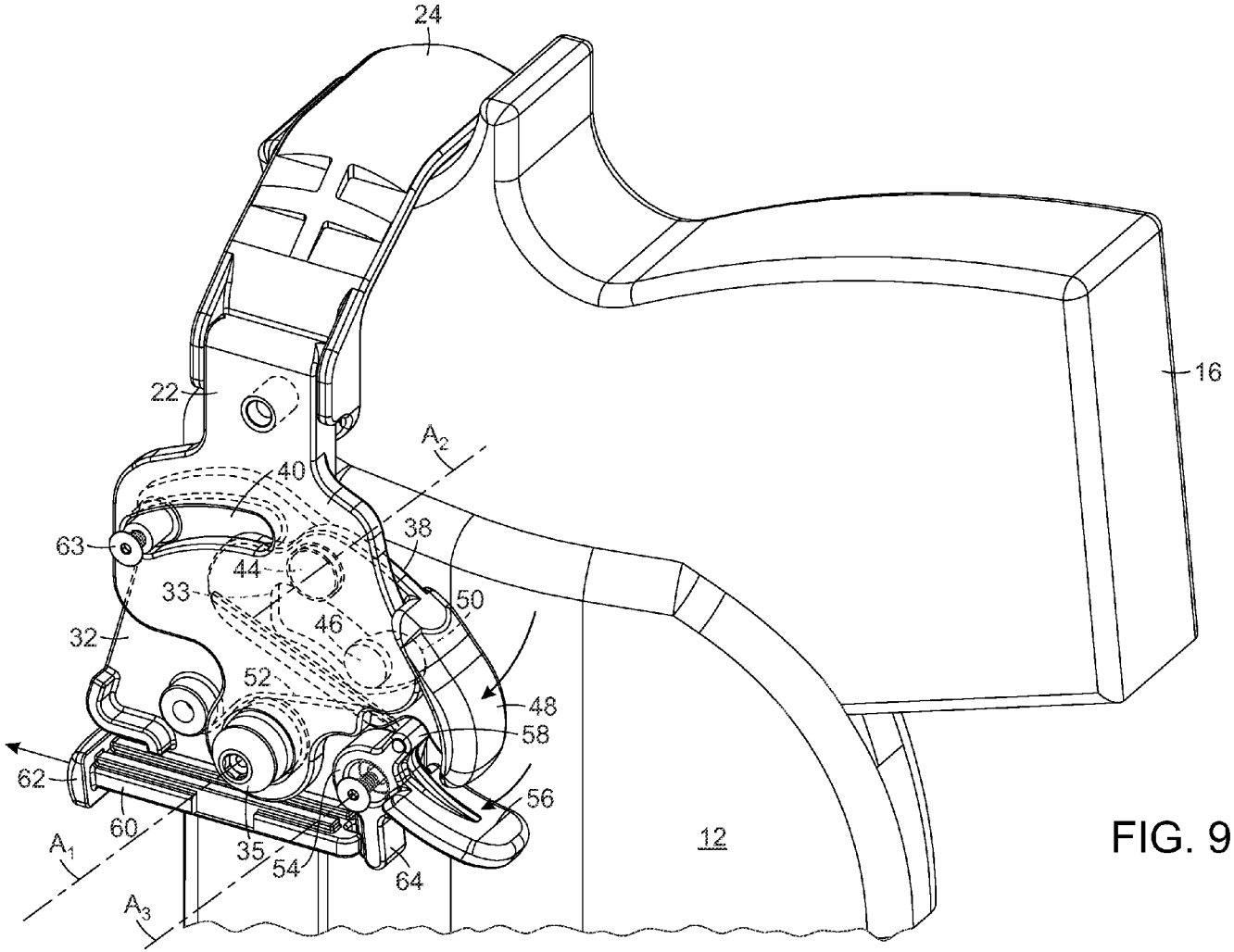
FIGS. 9 and 10 are views similar to FIG. 4 respectively showing the quick release device in an unlocked and then open condition.
Figure 10:
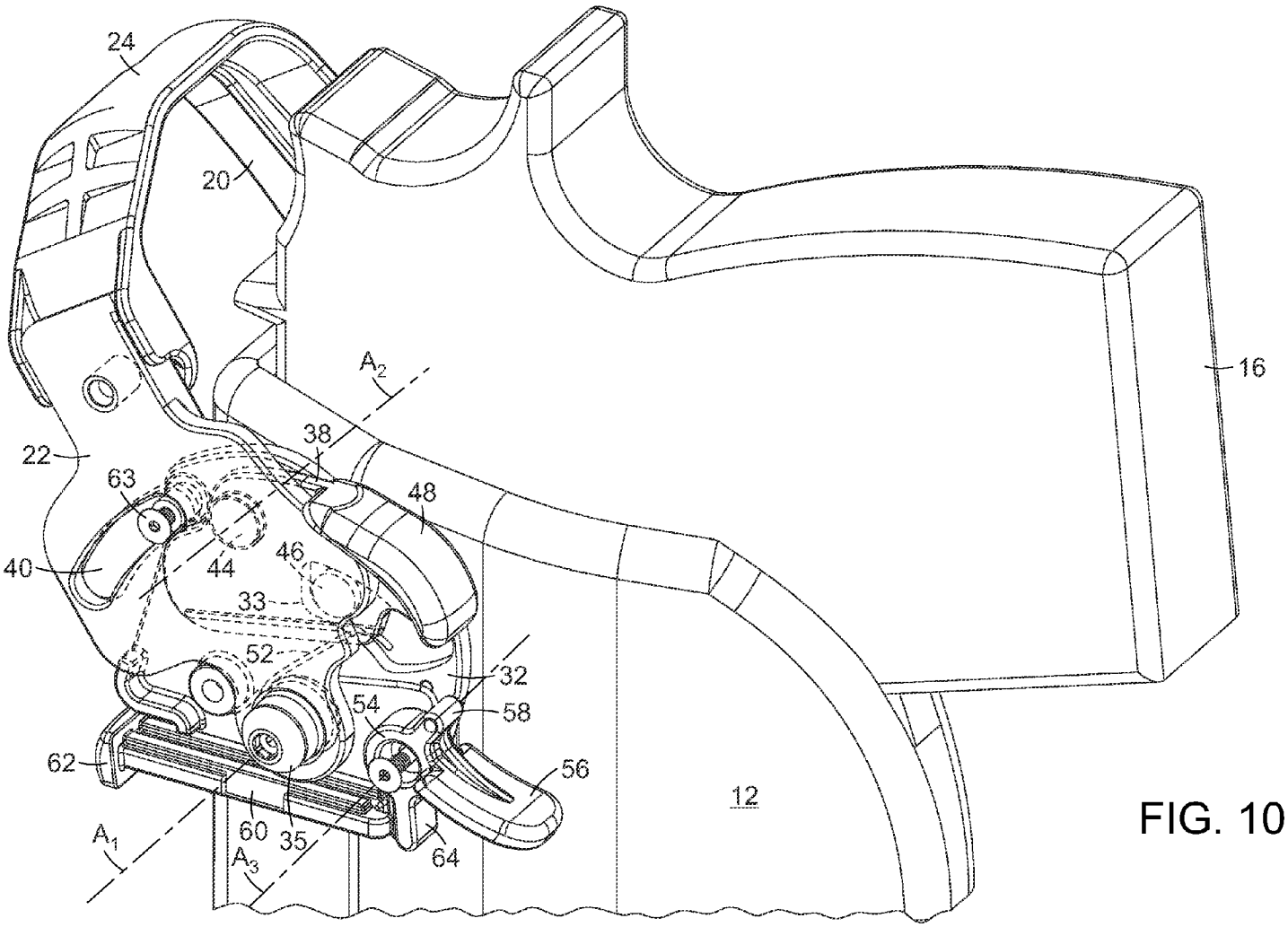

In order to gain access to the handgun 16, and as shown in FIG. 9, the safety lever 54 must first be pivoted in a clockwise direction, causing retraction of the pin 60, and removal of the safety lever's shoulder 58 from contact with the underside of the trigger plate 38. The trigger plate is then rotated about axis $A_2$ in a clockwise direction to disengage its rear boss 46 from the locking notch 50. Then, as shown in FIG. 10, the trigger plate is pushed forwardly, causing its rear boss 46 to move forwardly along the path P defined by groove 33. This forward movement is transmitted to the outer hood leg 22, and hence to the entire hood 18, by virtue of the engagement of the trigger plate's front boss 44 in the hole 42 in the outer hood leg 22. The hood 18 is thus rotated about axis $A_1$ to its forward position at which the bridge 24 is removed from the holster opening 14 to permit withdrawal of the handgun 16. Forward hood movement is arrested by engagement of the fastener 63 with the rear end of the slot 40

In light of the foregoing, those skilled in the art will now recognize that the quick release device of the present invention includes numerous novel and advantageous features, including, inter alia:

The spoon shape of the trigger plate thumb landing 48 which allows the user's thumb to unlock and drive the hood 18 forwardly to its open position as it descends to grip the handgun;

The location of the trigger plate thumb landing 48 and safety lever thumb landing 56 rearwardly and inboard of the outer side plate 34. This location guards both thumb landings from unauthorized operation by an assailant, while protecting them from obstruction against the user's body. This location of the trigger plate's thumb landing also allows the user to drive the hood 18 forwardly to its open position without altering his grip on the handgun.

The torsion spring 52 holds the trigger plate boss 46 in engagement with the locking notch 50 when the hood 18 is in its rearward position. Once the boss 46 is disengaged from the notch 50, the spring assists in driving the hood forwardly to its forward position.

The locking/unlocking motion of the hood 18 is accomplished solely by operation of the trigger plate 38, thus removing the danger of unwanted or inadvertent unlocking by depressing the hood, as is the case with known prior art locking devices.

The pivotal connection of the trigger plate 38 to the outer hood leg 22 allows the hood leg to be moved by the trigger plate (and vice versa), yet allows the trigger plate to rotate into and out of its locked position.

We claim:

1. A quick release device for preventing unwanted withdrawal of a hand gun from a holster, said holster having an opening through which the hand gun is inserted into and removed from the holster, said device comprising:

a generally U-shaped hood having mutually spaced legs spanned by a bridge, said legs being arranged to straddle said holster, with said hood being translatably fixed with respect to and rotatable about a fixed first axis between a rearward position at which said bridge overlies said opening to prevent withdrawal of the hand gun from said holster, and a forward position at which said bridge is removed from said opening to permit withdrawal of the hand gun from said holster;

at least one side plate fixed with respect to said holster at a location adjacent to one of said legs, said side plate being contoured to define a path bordered by and extending forwardly from a locking notch;

a trigger plate connected to the said one leg for rotation about a second axis parallel to said first axis, said trigger plate having a boss projection into said path;

spring means for exerting a yieldable force on said trigger plate urging said boss into said locking notch when said hood is in said rearward position, the interengagement of said boss with said locking notch serving to lock said hood in said rearward position, said trigger plate being rotatable about said second axis to overcome said force and to disengage said boss from said locking notch, thereby freeing said boss for movement along said path as said hood is rotated about said first axis from said rearward position to said forward position.

2. The quick release device of claim 1 wherein two of said side plates having complimentary profiles are arranged in a confronting interconnected relationship to define a space therebetween, with the said one leg and said trigger bar and spring means being located in said space.

3. The quick release device of claim 2 wherein said side plates are interconnected by a fastener extending therebetween and across an arcuate slot in the said one leg, said arcuate slot being disposed radially from said first axis and having a rearward end defining a stop limiting the degree of rotation of said hood from said rearward position to said forward position.

4. The quick release device of claim 2 wherein said side plates and said one leg are interconnected by a fastener defining said first axis, and wherein said spring means comprises a torsion spring encircling said fastener, with one end of said spring being anchored with respect to said plates, and with the other end of said spring bearing against said trigger bar.

5. The quick release device of claim 2 wherein said trigger plate projects rearwardly from said space to define a downwardly curved thumb landing surface.

6. The quick release device of claim 5 further comprising a safety lever for releasably preventing rotation of said trigger plate to disengage said boss from said locking notch.

7. The quick release device of claim 6 wherein said safety lever is mounted between said plates for pivotal movement about a third axis parallel to said first and second axes, said safety lever being pivotally adjustable between a first position abutting and preventing rotation of said trigger plate, and a second position permitting such rotation.

8. The quick release device of claim 7 wherein said safety lever projects rearwardly from said space to define a second thumb landing surface underlying the thumb landing surface of said trigger bar.

9. The quick release device of claim 8 wherein the thumb landing surfaces of said trigger bar and said safety lever are confined between planes containing said plates.

10. The quick release device of claim 7 further comprising a safety setting device for setting said safety lever in said first position.

11. The quick release device of claim 10 wherein said safety setting device comprises a pin positioned for slidable movement into and out of engagement with said safety lever.

12. The quick release device of claim 11 wherein said pin projects forwardly from said space to terminate in an enlarged head accessible at the front of said quick release device.

13. The quick release device of claim 1 wherein said path and said locking notch are defined by a shallow groove in one side of the said one side plate.

14. The quick release device of claim 1 wherein said boss is located on one side of said trigger plate, and wherein said second axis is defined by a second boss on the opposite side of said trigger plate projecting into a hole in the said one leg.

15. The quick release device of claim 1 further comprising:

a generally U-shaped saddle positioned over a front end of said holster, said saddle having arms straddling and fixed with respect to the sides of said holster, the legs of said hood being connected to said arms for rotation about said first axis.

16. The quick release device of claim 15 wherein distal ends of said arms are received in pockets in the sides of said holster.

17. The quick release device of claim 1 wherein said locking notch is located rearwardly with respect to a central plane containing said first axis and said hood when said hood is in said rearward position.

18. A quick release device for preventing unintended withdrawal of a handgun from a holster, comprising a generally U-shaped hood with mutually spaced legs spanned by a bridge, said legs being arranged to straddle the holster, with said hood being translatably fixed with respect to and rotatable about a fixed first axis between a rearward position at which said bridge overlies the holster opening to prevent withdrawal of a hand gun from the holster, and a forward position at which said bridge is removed from the holster opening to permit such withdrawal; at least one interior side plate fixed with respect to the holster at a location adjacent to one of said hood legs, said interior side plate being contoured to define a guide path bordered by and extending forwardly from a locking notch, and a trigger plate connected to said hood leg for rotation about a second axis parallel to said first axis, said trigger plate having a boss projecting into said guide path for engagement with said locking notch when said hood is in said rearward position, said trigger plate being rotatable about said second axis to disengage said boss from said locking notch, thereby freeing said boss for movement along said guide path as the hood is rotated about said first axis from its rearward position to its forward position.

* * * * *